United States Patent [19]

Konrad

[11] Patent Number: 4,589,210

[45] Date of Patent: May 20, 1986

[54] METHOD AND MEANS FOR CENTERLESS CIRCLE CONSTRUCTION

[76] Inventor: Joseph D. Konrad, 6340 Stumph Rd., Parma Heights, Ohio 44130

[21] Appl. No.: 605,208

[22] Filed: Apr. 30, 1984

Related U.S. Application Data

[63] Continuation-in-part of Ser. No. 486,106, Apr. 18, 1983, abandoned, which is a continuation-in-part of Ser. No. 321,471, Nov. 16, 1981, abandoned.

[51] Int. Cl.[4] ..... B43L 13/20

[52] U.S. Cl. ..... 33/27.03; 33/562

[58] Field of Search ..... 33/27 C, 27 D, 27 R, 33/27 K, 29, 30 R, 30 B, 174 B, 174 G; 434/87, 214; D10/64; D19/39, 40

[56] References Cited

U.S. PATENT DOCUMENTS

| | | | |
|---|---|---|---|
| D. 137,905 | 5/1944 | Kardux | 33/174 B |
| D. 165,849 | 2/1952 | Jordan | 33/174 B |
| 2,604,702 | 7/1952 | Collins | 33/174 B |
| 3,081,545 | 3/1963 | Bergman | 33/27 C |
| 3,568,327 | 3/1971 | Furuoka | 33/174 B |
| 3,813,787 | 6/1974 | Mercorelli | 33/174 B |
| 4,251,920 | 2/1981 | Cassagnes | 33/174 G |

*Primary Examiner*—Charles Frankfort
*Assistant Examiner*—Patrick R. Scanlon
*Attorney, Agent, or Firm*—Robert Bruce Henn

[57] ABSTRACT

A template set for inscribing a plurality of curvilinear figures with pencil, inking pen or other marking means is disclosed. The invention comprises a two-part unit for small circles, or a three-part unit for larger circles, enabling an individual circle or family of circles to be drawn without a compass, where such circles have a common center. The device can further be used to draw ellipses of varying size, the ellipses having varying sizes and degrees of eccentricity, and having common foci. The device consists of an exterior holder, an interior holder, a large-circle guide portion and a small-circle guide portion. In the embodiment for drawing large circles, a shim is used to maintain the large-circle guide portion in spaced relationship from the drafting medium.

5 Claims, 9 Drawing Figures

METHOD AND MEANS FOR CENTERLESS CIRCLE CONSTRUCTION

CROSS-REFERENCE TO RELATED APPLICATIONS

This application is a continuation-in-part of my copending application Ser. No. 486,106, filed Apr. 18, 1983, which was in turn a continuation-in-part of application Ser. No. 321,471, filed Nov. 16, 1981, both now abandoned.

BACKGROUND OF THE INVENTION

1. Field of the Invention

The present invention is in the field of drafting templates and guides. More particularly, this invention presents method and means to enable a draftsman to draw a series of concentric or similarly related closed circular figures without damage to the drafting medium.

2. Description of the Prior Art

Generally speaking, anyone using a pencil compass can draw any number of circles. However, professional drawing-board experience is essential in using a circle guide for drawing concentric circles of increasing or decreasing size for inking in drawings. In drawing such families of circles, it is difficult even for the experienced professional draftsman to obtain, e.g., 0.8-millimeter (mm) accuracy in spacing between circles, especially when inking-in is required.

Currently, when a professional draftsman is confronted with the problem of drawing a series of concentric circles, he has his choice of using a compass or a template of the existing art. Either choice has drawbacks. Drawing multiple circles with a compass tends to damage the paper where the point of the compass pierces the paper on repeated occasion as the different circles are drawn. To avoid this problem, the experienced draftsman may put a small piece of plastic on the drawing medium, and ground the point of the compass thereon. However, this method entails either the risk of the plastic slipping and destroying concentricity, or the uneconomical expenditure of time in affixing the plastic to the medium, such as by gluing or taping. Further, the repeated placement of the point of the compass does not always engage exactly the same position, leading to inaccuracies and lack of concentricity. While such inaccuracies may not be critical in conceptual drawings, they can introduce undesirable deviations from actual measurements in working shop drawings.

In using a template, each succeeding circle or other curvilinear figure must be centered by means of coordinating lines adjacent the appropriate hole in the template; however, no matter how careful the draftsman is, he is never completely sure that each succeeding figure is precisely centered or otherwise aligned. Further, the range of sizes available with current templates is somewhat restricted. In some cases, the lack of precision drawings can be critical, especially, as noted, where those drawings are used for shop and field work or in the presentation of patent illustrations. When the distance between adjacent figures approaches the thickness of the inked line, maintaining concentricity with existing templates also become marginal.

Another problem encountered with the apparatus and methods of the prior art is that a required series of circles to be drawn must be carefully planned. Generally, the smallest circle is drawn first, followed by those of increasing size. An attempt to proceed in the opposite fashion is difficult because the template, even though substantially transparent, often at least partly obscures the larger circle in the attempt to center the smaller. In the event that the draftsman discovers that he has to draw a series of circles concentric with one already drawn because of a change in specifications or for other reasons, it is not uncommon to have to remove the earlier-drawn figures and begin over. In the case where the circle has already been inked, the job becomes very difficult, and potentially damaging to the drafting medium.

Irrespective of the planning required in drawing circles with existing templates, a further problem arises where the range of the sizes of circles to be drawn is fairly great. Current practice requires the use of several templates, with the problems of careful alignment as already noted; further to that, however, is the circumstance that different templates may have different kinds of reference marks, which then requires that the draftsman pay particular attention to how he is aligning the template in order to avoid imprecision in the drawing.

While none of the problems discussed here are insurmountable, they are time-consuming, and detract from the productivity of the draftsman.

Even if the foregoing problems can be avoided, the draftsman now faces the problem of inking the pencil drawing without smearing the lines. Using templates of the prior art, the draftsman has to be careful not to permit the pen to contact the line where the template rests on the paper, or the ink will spread into that line by capillary action, causing his line to be thicker than he wants even assuming that he is able to control its actual placement with the necessary precision in the first place.

In present practice, when a draftsman makes an inked circle with a template, he places some kind of shim under the template to prevent its direct contact with the drawing medium to avoid capillarity. The use of the shim, however, invites both inaccuracy in the dimension of the circle and slippage of the template on the shim. To avoid the latter problem, the draftsman can tape the two together, but then tends to lose whatever time advantage he has gained by the use of the template.

Furuoka, in U.S. Pat. No. 3,568,327, shows what is essentially an amusement device for the production of epicyclic, hypocyclic and similar figures generated by the interrelation of a fixed reference point with another, moving point. By its very nature, the Furuoka device is incapable of producing concentric circles except by moving the template, a problem discussed hereinabove. The Furuoka apparatus further has means whereby the position of the template is fixed at specified angular intervals.

A device similar to that of Furuoka is described by Siegel in U.S. Pat. No. 3,699,660, differing from Furuoka in that it is adjustable to permit infinite variation among the designs generated. The Siegel device, however, is also limited in that it requires movement of the entire device to permit drawing of curvilinear figures related in size, but with a commonality of center or focus.

Jordan, in U.S. Pat. No. D 165,849, shows a drafting template whereby lines can be drawn at variable angles to an initial reference point or line. Use of the Jordan template requires the removal and replacement of screws to permit the template to be changed or the angle of a particular line altered.

None of the references discussed herein makes any provision for inking of a precision drawing, nor do they provide for the construction of a plurality of curvilinear figures without regard to the order in which the figures are drawn.

SUMMARY OF THE INVENTION

The means of the present invention comprises the combination of an exterior holder, an interior holder, a large-circle guide portion and a small-circle guide portion into a template set for the construction of a plurality of curvilinear figures; when large figures are drawn, a shim is used to maintain the proper distance of the large-circle guide portion from the paper. Preferred holder thickness is about 2.5 mm; the thickness of the guide portions and the shim is preferably about 1.2 mm, although greater or lesser thicknesses are within the spirit and scope of this invention. The exterior holder can be any shape; the preferred embodiment is square with round corners for ease and convenience of use. The circle guide portions have a family of hold diameters, and are raised above the surface of the drafting medium by the thickness of the respective holder, and in the case of the large-circle guide portion, by the further use of a shim. Both the shim and the interior holder fit into a recess in the exterior holder. The size and shape of the interior conformation of each holder is complementary with the size and shape of the exterior perimeter of the respective circle guide portion. The material used for this device is preferably a dimensionally stable, transparent and impact-resistant material such as, e.g., polystyrene, polyethylene, polyethylene terephthalate, polyvinyl chloride and the like. Any or all of the portions of the tool may be colored for convenience.

The method of the present invention comprises establishing X- and Y-axis lines on the drafting medium where the circles are to be drawn, aligning inscribed axis referents of the exterior or interior holder thereon, emplacing the appropriate circle-guide portion, and drawing the desired figure. For drawing a figure of different size, the guide portion is then moved within the holder while the holder is maintained fixed with respect to the medium, and the next figure drawn. The process is repeated for the number of figures desired. Where there is a large range of figures to be drawn, the shim within the exterior holder is removed after drawing large circles, and is replaced with the interior holder, without loss of alignment of the unit; the exterior holder is then removed if necessary or desirable, and further figures drawn with the use of the small-circle guide portion.

DESCRIPTION OF THE PREFERRED EMBODIMENTS

The preferred embodiment of the present invention comprises a device for inscribing related circular figures in mechanical drafting by increasing or decreasing the required sizes by establishing an X or Y axis, or both, of the device to coincide with the X and Y axis on a pencil drawing. The device is a template set consisting of at least one holder and a circle-guide portion. For large circles, a large exterior holder provides location means for a smaller interior holder, which in turn permits the small-circle guide portion to be precisely located. The exterior of the circle-guide portion is complementary in size and shape with the interior of the respective holder. As used herein, the term "circle guide" is defined as a template means for inscribing closed curvilinear figures, and includes both ellipses and circles. It is the unification in juxtaposition of a template device and a circle or ellipse guide to form a unitary device accomplishing concentricity and accuracy for circles, and commonality or family relationship for ellipses.

Figure 1:
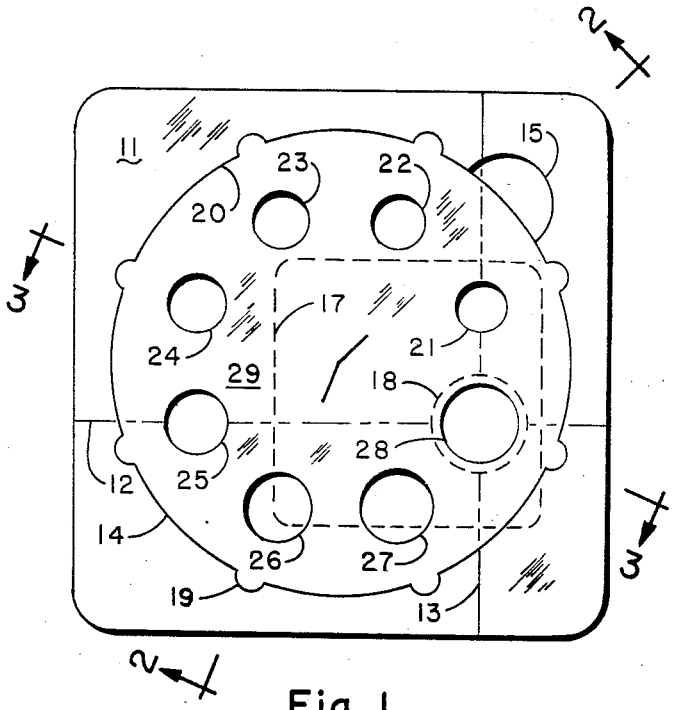
FIG. 1 is a plan view showing exterior holder and large-circle guide portion of the present invention.

Referring now to FIG. 1, the exterior holder is indicated generally at 11, and is shown with a square shape, although the shape is not necessary to the function of this invention. Inscribed axial lines 12 and 13 permit alignment of the device with coordinate lines on the drawing. Large-circle guide portion 29 has an exterior shape 20 complementary to the interior conformation 14 of holder 11, and has holes 21 through 28 of prescribed size, chosen to permit ease and flexibility of drawing. Such sizes include, e.g., about ½ inch (in.) through about 2 in. by appropriately chosen steps, or about 12 millimeters (mm) through about 51 mm in integral steps, although smaller and larger sizes are within the spirit and scope of this invention, the limit here being only the size constraints imposed by the size of exterior holder 11 and large-circle guide portion 29. In the body of exterior holder 11 is an access notch 15 to permit ready removal and replacement of large-circle guide portion 29, as discussed more fully hereinbelow.

Figure 6:
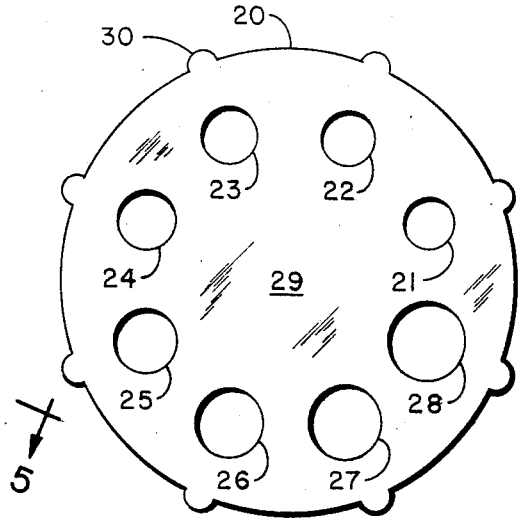
FIG. 6 shows the large-circle guide portion of the invention.

The interior conformation 14 of exterior holder 11 delineates the space into which large-circle guide portion 29 fits; the positioning of holes 21 through 28 is maintained with precise alignment in relation to lines 12 and 13 by the fit of projections 30 on guide portion 29, shown in FIG. 6, with recesses 19 on exterior holder 11. The specific size and shape of the alignment means is not critical, so long as their interrelationship retains the necessary alignment of the circle guide with the holder.

Figure 3:
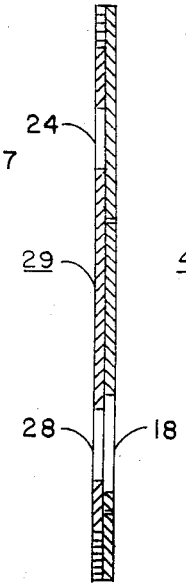
FIG. 3 is a view in section taken along lines 3—3 of FIG. 1.
Figure 4:
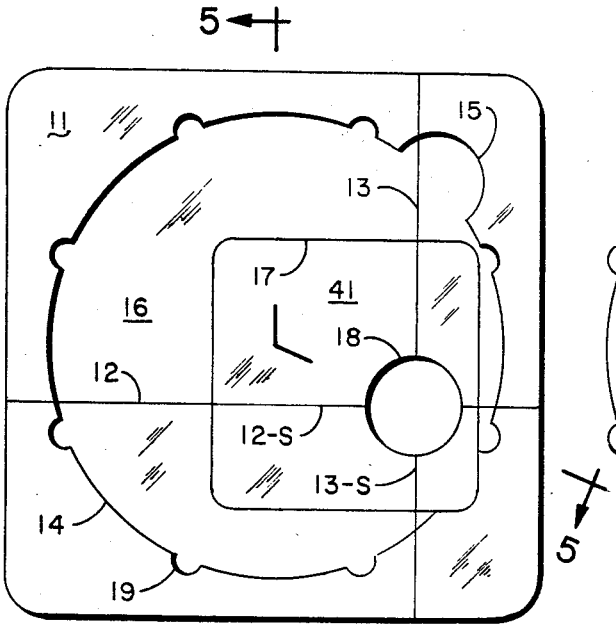
FIG. 4 is a plan view of the exterior holder with the shim therein.
Figure 7:
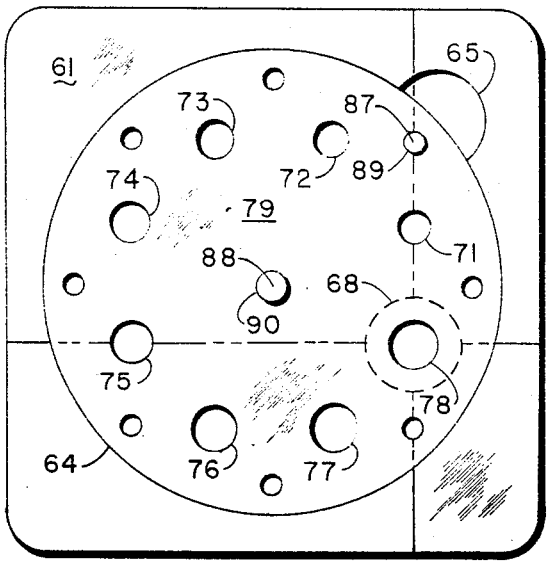
FIG. 7 is a plan view of the interior holder with the small-circle guide emplaced therein.

Shim 41, shown in FIG. 4, has a shape as defined by, and juxtaposed within, recess 17, and is discussed more fully with respect to FIGS. 3, 4 and 7. Referring back to FIG. 1, hole 28 in large-circle guide portion 29 is juxtaposed over hole 18 in shim 41.

Figure 2:
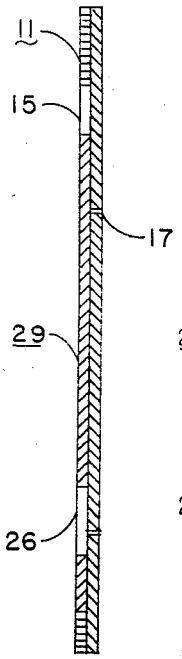
FIG. 2 is a view in section taken along lines 2—2 of FIG. 1.

FIG. 2 is a view in section taken along lines 2—2 of FIG. 1. The section is taken through access notch 15 and hole 26 in large-circle guide portion 29, and shows shim 41, the size and shape of which is defined by recess 17, juxtaposed in exterior holder 11.

FIG. 3 is a sectional view taken along lines 3—3 of FIG. 1. The section is taken through hole 18 in shim 41, and holes 24 and 28 of large-circle guide portion 29. As shown in FIGS. 1 and 3, hole 28 is juxtaposed over hole 18. Hole 18 is larger than any of the holes 21 through 28 of large-circle guide portion 29; therefore, shim 41 acts as a spacer to prevent large-circle guide portion 29 from physically touching the surface of the drafting medium, and prevents capillarity from spreading the ink when a line is drawn with a pen.

FIG. 4 shows a plan view of exterior holder 11 with shim 41 in place, large-circle guide portion 29 having been removed from the view shown in FIG. 1. Axial lines 12*s* and 13*s* on shim 41 are extensions of and colinear with lines 12 and 13 on exterior holder 11.

Figure 5:
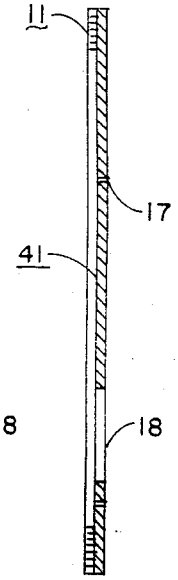
FIG. 5 is a sectional view taken along lines 5—5 of FIG. 4.

FIG. 5, a sectional view taken along lines 5—5 of FIG. 4, shows exterior holder 11 with shim 41 in place in recess 17. Hole 18 is shown in shim 41.

FIG. 6 shows large-circle guide portion 29 removed from the assembled invention as shown in FIG. 1. Circumferential line 20 is complementary with interior conformation 14 of exterior holder 11. As noted previously, alignment tabs 30, in cooperation with alignment recess 19 in exterior holder 11, cause circles 21 through 28 each to be aligned with respect to exterior holder 11. By using circles 21 through 28 to draw circles, each such circle is maintained in a concentric relationship with any other circle drawn when exterior holder 11 is maintained in its original position. Exterior holder 11 is conveniently maintained in position by, e.g., taping to the drafting medium or weighing or clamping down.

FIG. 7 is a plan view of interior holder 61, with small-circle guide portion 79 in place. Access notch 65 serves the same function for small-circle guide portion 79 as does access notch 15 for large-circle guide portion 29; hole 68 serves the same function as does hole 18 in position 29. Holes 71 through 78 in small-circle guide portion 79 permit congruent circles from about 1/16 in. or about 1 mm up to about ½ in. or about 12 mm to be drawn, in a fashion similar to that as described with respect to exterior holder 11 and large-circle guide portion 29.

Figure 8:
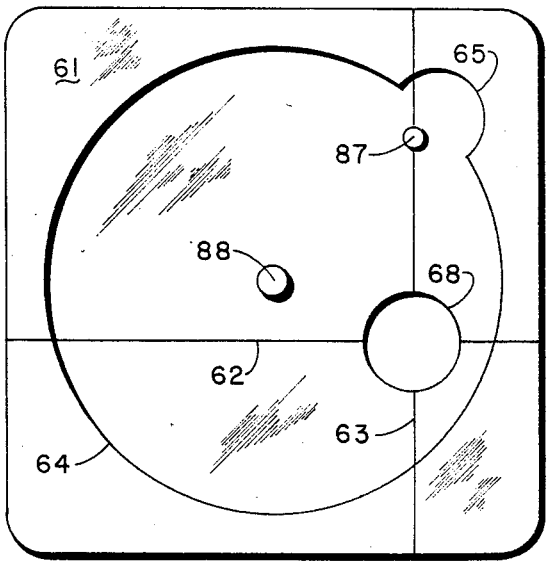
FIG. 8 shows the interior holder.
Figure 9:
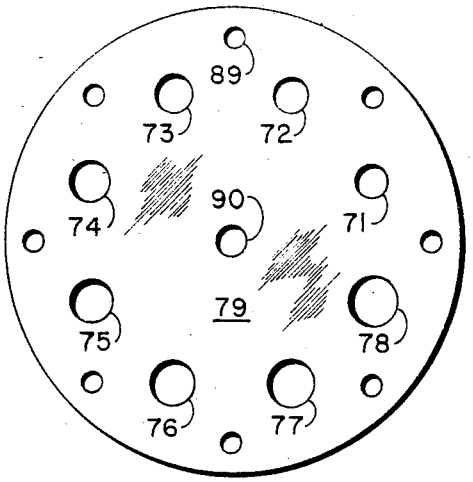
FIG. 9 shows the small-circle guide portion.

FIG. 8 is a plan view of interior holder 61, small-circle guide portion 79 having been removed from the view shown in FIG. 7. Interior conformation 64 of interior holder 61 is a circle; locating pin 87 and post 88 permit precise alignment of small-circle guide portion 79, shown in FIG. 9, by the juxtaposition of locating hole 89 and center hole 90, respectively.

Referring again to FIG. 8, axial lines 62 and 63 serve the same function as do lines 12, 13, 12*s* and 13*s* of exterior holder 11 and large-circle guide portion 29.

Interior holder 61 is identical in size and shape with shim 41, fitting snugly enough in exterior holder 11 to prevent movement of the exterior and interior holders with respect to each other, but loosely enough to permit ready insertion or removal of interior holder 61 into or from exterior holder 11.

In the utility of this invention, a drawing is made on a suitable medium which will properly receive pencil or ink. Horizontal and vertical axis lines X and Y are first conveniently drawn in pencil to provide a reference point at their intersection. If large circles art to be drawn, exterior holder 11 is placed over the area with hole 18 in shim 41 juxtaposed by means of axial lines 12 and 13 and 12*s* and 13*s* over the intersection of the lines drawn on the drafting medium. Large-circle guide portion 29 is aligned by the spatial relationship of recesses 19 and tabs 30, and the desired circles drawn. A given circle having been drawn, large-circle guide portion 29 is removed by using access notch 15, the guide portion 29 moved to present the next desired size, and the succeeding circle drawn. The process is repeated as desired.

For both the large-circle guide portion 29 and the small-circle guide portion 79, the alignment moiety of its respective holder, comprising the locating means 19 and 87 in coooperation with 30 and 89 respectively, permits the guide portion to be removed, rotated, inserted, restored to the original position, or any such operation, all without loss of alignment or concentricity of the drawn figures one from another. The foregoing presumes that the holder 11 or 61 is maintained in place when the circle guide is moved.

In the event that small circles are required, shim 41 is removed, and interior holder 61 placed at the same position. Small-circle guide portion 79 is then placed in interior holder 61. If desired, exterior holder 11 can now be removed. With the appropriate hole of small-circle guide portion 79 juxtaposed over the center of the circle to be drawn, center hole 90 on post 88, and the appropriate locating hole 89 placed on locating pin 87, precision alignment of the smaller circles is assured, down to the limit imposed by the thickness of the drafting tool.

Those skilled in the art will realize that it is immaterial whether a small or a large circle is the first in a family drawn with the method and means of the present invention. As already noted, interior holder 61 can be placed within exterior holder 11 to provide a referent for small circles. If the smaller circles have been drawn first, exterior holder 11 is placed over interior holder 61, holder 61 removed, and shim 41 substituted. Large-circle guide portion 29 is then used to make larger circles as desired.

If it is necessary to erase any curvilinear figure, whether it is to be redrawn as originally done, or substituted with another figure, the guide can be used as an eraser shield, or the figure simply erased and replaced with another figure. In any event, the invention provides the draftsman with a tool which significantly improves his productivity while at the same time saving undue wear on the drafting medium.

Another use of the guide means of the present invention is that of drawing shadow or relief lines on circles. Once the desired circle is drawn, the skilled draftsman can use the next larger hole to permit him to draw a shadow line, by judicious angling of the pen or pencil. For even the less-experienced person, the guide can be used by shifting it slightly to permit the same circle to be used to draw the shadow line.

Those skilled in the art will realize that for each diameter of circle to be drawn, there is a unique guide hole. Accuracy and alignment are assured each time there is a change in diameter, size, or in the case of ellipses, eccentricity with or without a change in size, due to the fixed relationship of outer portion 11 with the drafting medium.

Modifications, changes and improvements to the preferred shape and forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited only to the advance by which the invention has promoted the art.

I claim:

1. A template set for constructing curvilinear figures consisting of an exterior holder with a cavity defining an interior conformation and a recess extending through the holder; a large-circle guide portion adapted to fit into said cavity of said exterior holder and a shim with an exterior perimeter adapted to fit into said recess, said large-circle guide portion being complementary in size and shape with said interior conformation of said exterior holder and including a plurality of curvilinear cutouts, the exterior perimeter of said shim being complementary in size and shape with said recess of said exterior holder; said shim including at least one opening, whereby, when one of said curvilinear cutouts of said large-circle guide portion is aligned with said opening of said shim, a user can construct a curvilinear figure.

2. The template set of claim 1 having further an interior holder with an exterior size and shape and a cavity defining an interior conformation, said interior holder being adapted to fit into said recess; a small-circle guide portion being adapted to fit into said cavity of said interior holder and having a plurality of curvilinear cutouts and an exterior perimeter, the exterior size and shape of said interior holder being identical with said shim and with said recess of said exterior holder, and the exterior perimeter of said small-circle guide portion being complementary with said interior conformation of said interior holder; said interior holder including an aperture extending therethrough, whereby, when one of said curvilinear cutouts of said small-circle guide portion is aligned with said aperture of said interior holder, a user can construct a curvilinear figure.

3. The template set of claim 1 wherein said template set is made of a transparent, dimensionally stable, impact-resistant material.

4. The template set of claim 2 wherein said large and small circle guide portions have circular holes therein.

5. The template set of claim 2 wherein said exterior and interior holders and said large and small circle guide portions have alignment means thereon.

* * * * *